US005730514A

United States Patent [19]

Hashemi

[11] Patent Number: 5,730,514

[45] Date of Patent: Mar. 24, 1998

[54] SHOCK ABSORBING LOCKING DISCONNECT LATCH FOR BALL BEARING SLIDES

[75] Inventor: David Hashemi, Phillips Ranch, Calif.

[73] Assignee: Accuride International, Inc., Santa Fe Springs, Calif.

[21] Appl. No.: 649,453

[22] Filed: May 17, 1996

[51] Int. Cl.[6] ..... A47B 88/16

[52] U.S. Cl. ..... 312/333; 312/334.47

[58] Field of Search ..... 312/333, 334.44, 312/334.46, 334.47; 384/21, 18, 14

[56] References Cited

U.S. PATENT DOCUMENTS

| | | | |
|---|---|---|---|
| 4,401,350 | 8/1983 | Fortune | 312/333 X |
| 4,423,914 | 1/1984 | Vander Ley | 312/334.47 X |
| 4,549,773 | 10/1985 | Papp et al. . | |
| 4,560,212 | 12/1985 | Papp et al. . | |
| 5,255,983 | 10/1993 | Parvin | 312/333 X |
| 5,542,759 | 8/1996 | Krivec | 312/333 X |

*Primary Examiner*—Peter M. Cuomo
*Assistant Examiner*—Janet M. Wilkens
*Attorney, Agent, or Firm*—Christie, Parker & Hale, LLP

[57] ABSTRACT

A shock absorbing locking disconnect latch comprises a lever having a generally upwardly sloping front surface, a detent for positively arresting the longitudinal travel of a slide member during extension, and at least one vertical slot to enable flexing of the disconnect latch for removal or retraction of the slide member from a longitudinal channel. The front sloping surface leading to the detent allows the lever to flex until the detent has been reached and engaged by a guide post in the longitudinal channel which engages the detent and locks the slide member in a working position preventing unintentional retraction of the slide member or extension of the slide member. When the longitudinal channel is stopped by the detent of the disconnect latch, the shock energy is absorbed using the slot by deflection of the disconnect latch. Inward longitudinal pressure on the slide member in the working position causes a degree of flexure of the latch releasing the latch and permitting the slide members to be retracted to their original position. The latch can also be released from its locked position to permit further extension and removal of the slide member.

17 Claims, 4 Drawing Sheets

SHOCK ABSORBING LOCKING DISCONNECT LATCH FOR BALL BEARING SLIDES

FIELD OF THE INVENTION

This invention generally relates to disconnect latches for ball bearing slides used with keyboard trays and the like. The invention specifically relates to a disconnect latch capable of reliably locking slide members in a working position, eliminating unintentional disconnection or retraction, and absorbing the shock and noise energy created from stoppage at the working position. The latch also permits easy disengagement from the working position and removal or retraction of the slide members.

BACKGROUND OF THE INVENTION

Drawers are often mounted within cabinets using ball bearing slides. Such slides permit easy access to the interior of the drawer. The slides maintain the drawer in a horizontal position regardless of how far the drawer is withdrawn from the cabinet.

Occasionally, a drawer must be removed from the cabinet, for example for repair or maintenance. Therefore, the slides preferably include means for allowing the drawer to be readily removed from the cabinet. However, the slide must also have means for preventing accidental or unintended disengagement of the drawer when the drawer is fully extended. In addition, because the drawer slides must typically withstand many years of repetitive opening and closing, there is a need for drawer slides which continue to operate smoothly over extended periods of use. All drawer slides must endure severe industry performance testing. For example, one common test for drawer slides requires slide mechanisms to withstand both 15,000 two-inch travel cycles and five 80% travel cycles in response to a 15 pound pull while the drawer carries up to a 100 pound load. In another common test, the slide and latch must complete 50,000 full travel cycles under rated load.

Previous designs for drawer slides encountered many disadvantages in operation. Prior slides had a disconnect latch secured to one guide or member of the slide to prevent unintentional disengagement of another slide member. Removing drawers was previously accomplished by pushing up or down on an arm of the latch, thereby rotating the latch to pivot about a rivet or an extruded post encompassed by a rivet, providing space for the slide member to be disengaged. Excessive noise was also a problem. Such prior art designs are described in U.S. Pat. Nos. 4,560,212 and 4,549,773 and illustrated in FIGS. 1 and 1*a*.

In response to the problems associated with prior latches, applicant developed a drawer slide which promotes smooth, noise-free movement of the disconnect latch as disclosed in U.S. Pat. No. 5,255,983 (the '983 patent).

The '983 patent discloses a shock absorbing disconnect latch for a drawer slide comprising a wall or stop, limiting longitudinal travel of a slide member, a latch body having at least one vertical slot which permits both flexing of the latch to enable disengagement of the slide member, and also absorption of the shock and noise energy created when the slide member is stopped. A longitudinally elongated lever is formed unitarily with the latch body to enable flexing of the latch using downward or upward pressure on the lever.

Although the design of the '983 patent solved many of the problems associated with prior art latch designs, the design of the '983 patent has proven to be limited in certain applications where the longitudinal travel of the drawer slide needs to be rigidly arrested in a working position, such as for a computer keyboard drawer. In such applications the drawer needs to be extended horizontally outwardly to a working position for keyboard use. In this working position, it is necessary that the drawer remain in the working position without sliding horizontally inward under inadvertent force by the user of the keyboard. The latch mechanism of the '983 patent, which prevents inadvertent removal of the slide mechanism, does not prevent the inadvertent retraction of the slide mechanism once the drawer is extended into a working position.

Previous designs for drawer slides including latches to hold the slide in a working position included metal, spring actuated, lock out latches. These latches incorporated a locking mechanism to hold the drawer slide in the working position but suffered from the inconvenience of requiring manual manipulation (depression of a lever) to retract the slide to a closed position. A variation of these latches incorporated a roller which acted against a stop in the slide assembly to lift the latch during retraction. These designs encountered many disadvantages including the requirement of a high force to be exerted between the roller and the stop to retract the drawer. In addition due to the small amount of space in the slide assembly, the allowable size of the roller was limited. This lead to a large variation in performance due to among other things, manufacturing tolerances due to the small roller size, tightness of rivets in the construction, variation in spring tension, and cycle life of the spring. Such prior art designs are described in U.S. Pat. No. 4,549,773 and illustrated in FIGS. 1*b* and 1*c*.

Consequently, a need exists for a shock absorbing disconnect latch for a drawer slide capable of positively arresting the longitudinal travel of a slide member in a fixed working position and thereafter being released and either extracted or easily returned to its stored position.

SUMMARY OF THE INVENTION

The present invention provides a shock absorbing locking disconnect latch for a drawer slide having a detent for positively arresting the longitudinal travel of a slide member in either direction. The latch body is unitarily formed with the detent and at least one vertical slot which permits both flexing of the latch to enable unlocking and disengagement of the slide member, as well as absorption of shock and noise energy created when the slide member is stopped. A longitudinally elongated lever is formed unitarily with the latch body to enable flexing of the latch using upward or downward pressure on the lever. The lever has a sloping surface leading to a detent. The sloping surface allows the lever to flex until the detent has reached and engaged a block or post on a mating element on a channel element of the drawer slide locking the drawer slide in a working position. When the latch is depressed to unlock the drawer from the working position, or to remove the drawer, the latch flexes under pressure. This flexing design eliminates the need for critical dimensions of the pivoting components, so manufacturing costs and complexity are lessened. The latch is injection molded as a single piece and has a non-rotating mounting hole which simplifies manufacturing.

The disconnect latch dissipates shock energy by deflecting in the same direction as the impact load. Once the impact energy has been absorbed, the disconnect latch returns to the original non-impacted position. This greatly reduces the transmitted peak load that must be absorbed by the disconnect latch. Thus the reliability of the latch is increased.

BRIEF DESCRIPTION OF THE DRAWINGS

Details of the invention are described below and will be more fully appreciated with reference to the accompanying drawings.

DETAILED DESCRIPTION

Figure 1:
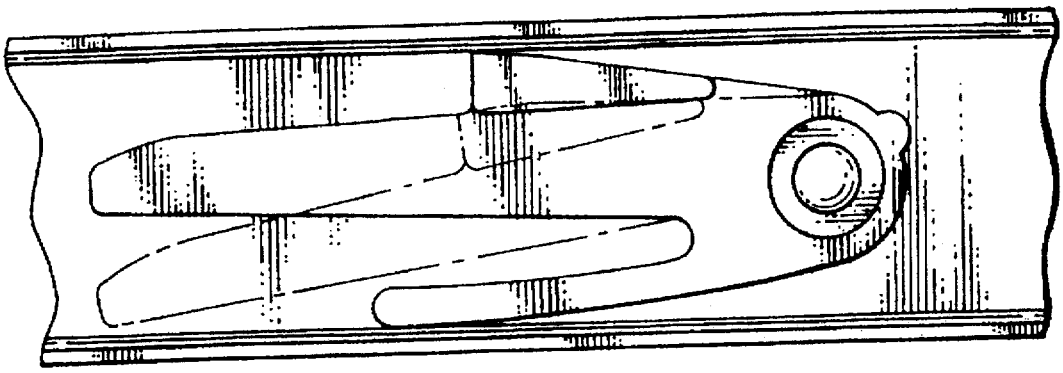
Fig. 1 PRIOR ART
FIG. 1 is an elevation view of a prior art pivoting style disconnect latch fitted to a drawer slide member with a depressed position of the lever in phantom.
Figure 1A:
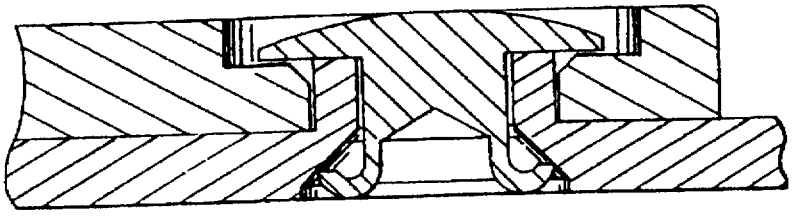
Fig. 1a PRIOR ART
FIG. 1*a* shows a side cross-sectional view of the counterbored ring taken on line 1*a*–1*a* of FIG. 1.
Figure 1B:
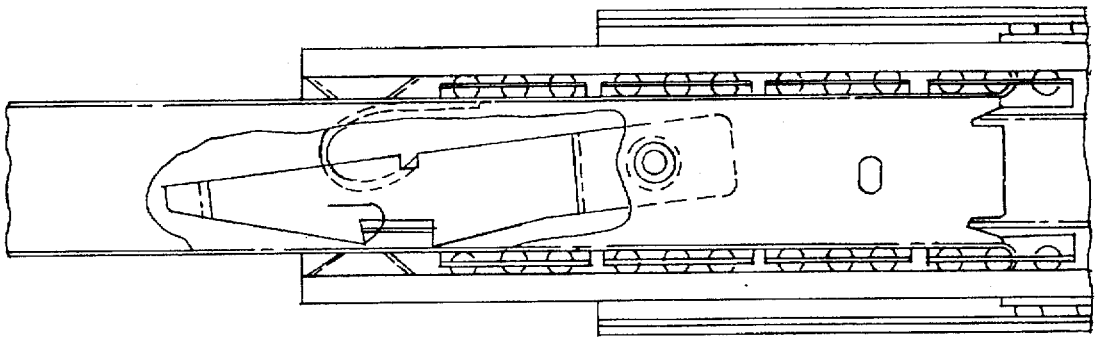
Fig. 1b PRIOR ART
FIG. 1*b* is an elevation view of a prior art spring actuated locking latch fitted to a drawer slide member.
Figure 1C:
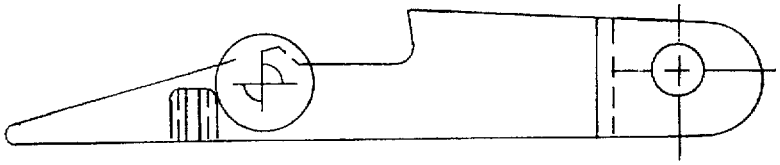
Fig. 1c PRIOR ART
FIG. 1*c* is a side view of prior art locking latch including a roller for retraction.
Figure 2:
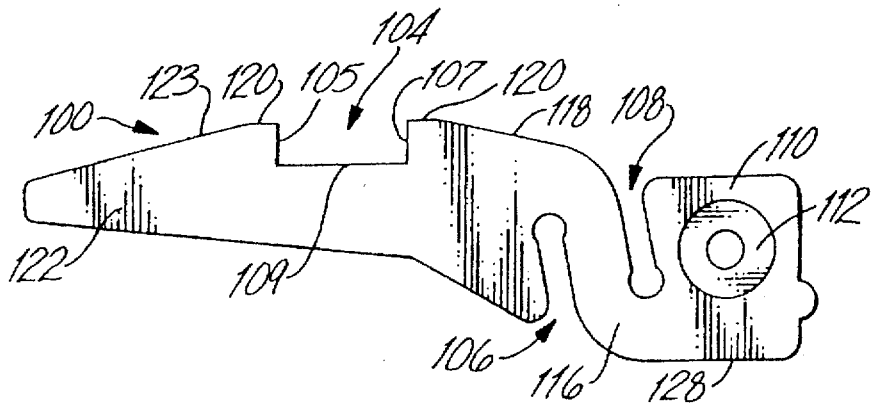
FIG. 2 is an elevation view of the invention.

The present invention, a shock absorbing locking disconnect latch 100, is shown in FIGS. 2 to 6. Like reference numbers in the figures identify similar parts. The disconnect latch 100 preferably is secured to a longitudinal channel 14 of a drawer slide 10. The longitudinal channel 14 includes top and bottom slide retainers 12 and 16, respectively, spaced apart by any desired slide width. The width of the channel 14 is approximately equal to the width of the non-impacted disconnect latch 100.

The disconnect latch 100 comprises a lever 122 which extends horizontally parallel to the slide retainers 12 and 16. The lever includes a generally upwardly sloping front wall 123 extending towards slide retainer 12. A locking detent 104 is formed in the lever and includes a front wall 105, a rear wall 107 and a bottom wall 109. A downwardly sloping rear wall 118 joins the lever and detent to a bridge portion 116 and a rear section 110. The rear section 110 includes a generally horizontal bottom edge 128 and is integrally formed with the bridge and the lever. When the latch is mounted in the channel 14 in its normal position, retainer 12 is adjacent the top 120 of surfaces 123 and 118 and retainer 16 is adjacent the edge 128 of the rear section 110.

Figure 3:
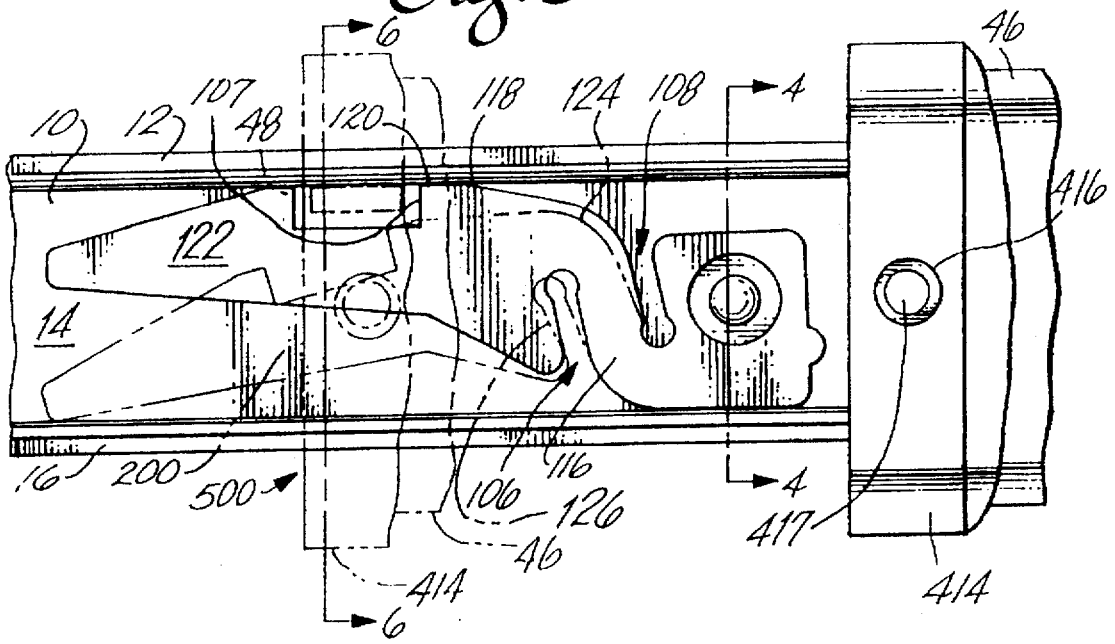
FIG. 3 is an elevation view of a latch of the invention fitted to a drawer slide in side view, with a flexed position of the lever and a stopped position of a guide rail shown in phantom.

Detent 104 locks the drawer slide 10 in a fixed working position as shown in FIG. 3 by the phantom position 500 of guide rail 414. The guide rail 414 includes a guide block 46 (see FIG. 6) positioned on an inside surface of the guide rail. The guide rail and the guide block include a recess 416 for a rivet 417 to firmly secure the guide block to the guide rail. The guide block 46 includes a stopping post 48 which extends into the detent 104 to lock the drawer slide in the working position 500. Alternatively, a metal stop could be formed on the inside of the rail instead of the guide block and stopping post arrangement.

When the disconnect latch 100 is moved to its locked position, wall 107 of the detent will engage and stop against post 48 when the drawer is opened. Wall 107 prevents the drawer from being pulled out of the guide rail. As the drawer is withdrawn, the post will initially engage the proximal sloping surface 123 bending the lever downwardly until the detent reaches post 48, engages it and the lever springs back to its normal position and wall 107 is in contact with post 48. Post 48 will also contact and stop against wall 105 to prevent the drawer from being inadvertently closed, thereby maintaining the drawer in the working position. Thus, the combination of the detent and the stopping post 48 blocks the movement path of the disconnect latch and the drawer slide 10 to which the latch is attached.

Figure 6:
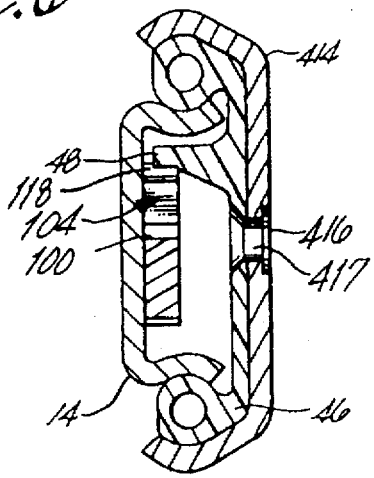
FIG. 6 shows a cross-section view of the latch of FIG. 3 in the deflected position and attached to a slide member with a guide block interconnecting with another slide member.

To release the drawer slide 10 from the working position to remove the drawer from the guide rails, the disconnect latch is manually flexed downwardly by finger pressure allowing the detent 104 to clear the post 48 and enable the drawer slide 10 to move past the guide block 46. Such a slide position is shown in FIG. 6 and by the solid-line placement of guide rail 414 in FIG. 3. As viewed in cross section in FIG. 6, in this position the latch is past the stopping post 48 with angled wall 118 visible behind the post and the detent 104 in front of the post.

When the disconnect latch is depressed by finger pressure to position 200, as shown in phantom in FIG. 3, the bottom slide retainer 16 is adjacent to and/or touches the disconnect latch lever 122. Edge 128 of the rear section bears against the retainer 16 and provides leverage for pushing the lever 122 down. Detent 104 will then clear post 48 to enable removal of the drawer slide 10.

To release the drawer slide 10 from the working position to retract the drawer, the stopping post can be manually pushed in a longitudinal direction against wall 105 with sufficient force to compress slot 106 forcing lever 122 downwardly allowing stopping post 48 to move out of detent 104. Although detent 104 prevents inadvertent retraction of the drawer slide 10, with enough force (approximately 10 lbs.) applied to the latch, the drawer can be retracted to a storage position.

Figure 4:
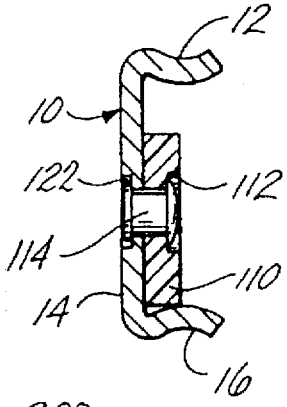
FIG. 4 shows a cross-sectional view of the latch taken on line 4—4 of FIG. 3.

Preferably the disconnect latch 100 is secured to the longitudinal channel 14 using a fastener 114, such as a rivet or an integrally formed annular, extruded post which secures the latch in an annular recess 112. FIG. 4 shows a sectional view of the recess 112 holding the rivet 114. The recess embraces the rivet so that the disconnect latch is attached to the longitudinal channel by the rivet passing through the latch and a matching hole 122 in the channel.

Reduced noise impact is promoted by vertical slots 106 and 108 provided along the longitudinal axis of the drawer slide. Each slot 106 and 108 is generally vertical and preferably formed with arcuate terminal ends. The slots are shaped similar to a keyhole, so that preferably the mouth of each slot is wider than the curved terminal. The slot 108 has its curved terminal closer to the retainer 16, while slot 106 has its curved terminal closer to the retainer 12. The slots preferably have an opposed orientation and the slot 108 is longitudinally proximal, while the slot 106 is longitudinally distal, in relation to the rivet 114. The slots thus are spaced apart with a bridge portion 116 interposed between the slots.

The bridge 116 is surrounded on either side by the slots. The bridge is formed unitarily with the rear section 110 and the downwardly sloping wall 118. As seen best in FIG. 3 when the lever 122 is depressed, the proximal edge 124 of the bridge 116 adjacent to the slot 108 moves counterclockwise which laterally widens the slot 108. The distal edge 126 of the bridge adjacent to slot 106 also moves counterclockwise which laterally compresses the slot 106. Thus there is enough space provided for the slide member to clear the normally abutting wall 107 of the detent 104.

Figure 5:
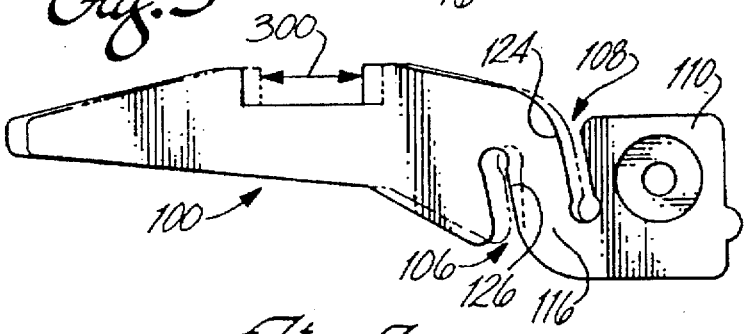
FIG. 5 is an elevation view of the disconnect latch of the present invention with a deflected position of the disconnect latch, under impact load, shown in phantom.

The use of at least one vertical slot results in the absorption of the shock energy created by the contact of the detent 104 with the stopping post 48. Under impact load in both horizontal directions 300 as shown in FIG. 5, the proximal edge 124 of the bridge 116 adjacent to the slot 108 moves horizontally which laterally narrows or widens the slot 108 depending upon the direction of movement of the drawer. The distal edge 126 of the bridge adjacent to slot 106 also moves horizontally which laterally compresses or expands the slot 106 depending upon the direction of movement of the drawer.

Also, when the lever 122 is depressed, the first vertical slot 108 laterally expands while the second vertical slot 106 laterally compresses.

The flexing of the vertical slots 106 and 108 eliminates the need for the rear section 110 to pivot about the rivet 114. Instead, the latch is preferably made of nylon or other suitable hard, resilient material, so that spring resilience of the latch causes the latch to return to its original position. Thus the disconnect latch 108 is more reliable in returning the lever 122 to its non-impacted position. Also the flexing method eliminates the need for precise parameters on the recess depth and diameter, extruded post height, and rivet clinch, so manufacturing costs and complexity are lessened.

Figure 7:
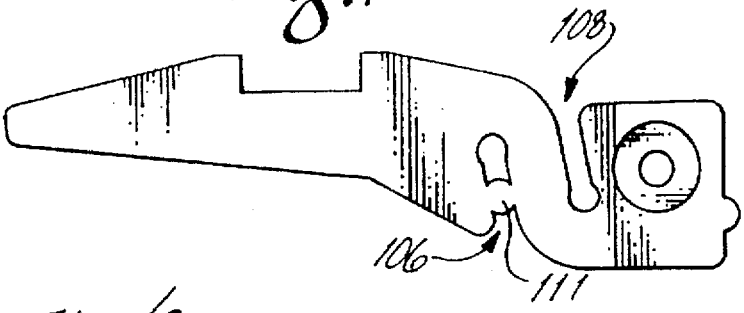
FIG. 7 is an elevation view of an alternative embodiment of FIG. 2.

The invention can be practiced in many different embodiments and variations. For example, the number of slots can vary and still ensure flexing of the latch. Or, as shown in FIG. 7, a stiffener 111 can be placed in slot 106 to provide additional resistance to flexing for applications where a heavy duty latch would be advantageous. Stiffener 111 could be placed in either slot 106 or slot 108 to provide the additional resistance. Although the slots must be vertical, they can be positioned in numerous locations along the longitudinal axis of the longitudinal channel. The slots can be constructed in various shapes; it is not necessary to employ a keyhole shape or rounded head. For example, a slot could have a triangular shape. Thus, the invention can be adapted to various sized slide assemblies and can interface with variously shaped slide members. All changes which come within the meaning and range of equivalency of the claims are intended to be incorporated within the scope of this invention. The present embodiments of this invention should be considered in all respects as illustrative and not restrictive; the scope of the invention to be indicated by the appended claims rather than the foregoing description.

What is claimed:

1. A locking disconnect latch for a slide assembly, the slide assembly including at least one elongated channel and a guide rail, the disconnect latch comprising the unitarily formed combination of:

integral detent means for releasably securing the slide assembly in a working position thereby preventing further extension or retraction of the channel;

first means for flexing the disconnect latch for extending the slide assembly to the working position and for absorbing shock energy produced when the channel is stopped against the detent means; and second means for flexing the disconnect latch for retraction of the slide assembly from the working position.

2. The locking disconnect latch of claim 1 wherein the first means for extending the slide assembly to the working position includes a generally sloping surface adjacent the detent means and at least one generally vertical slot on the latch behind the detent means.

3. The locking disconnect latch of claim 1 wherein the second flexing means comprises at least one generally vertical slot.

4. The locking disconnect latch of claim 3 wherein the generally vertical slot is laterally compressible.

5. The locking disconnect latch of claim 3 wherein the generally vertical slot is laterally expandable.

6. The locking disconnect latch of claim 1 wherein the first flexing means further comprises two opposed, generally vertical spaced-apart slots.

7. The disconnect latch of claim 6 wherein the two generally vertical slots are spaced apart and open in opposing directions, one of the slots facing upwardly and one facing downwardly.

8. The locking disconnect latch of claim 6 wherein one of the slots includes a stiffener.

9. A slide assembly comprising:

at least one elongated slide member movable within a rail; and a locking disconnect latch comprising an integral detent means for stopping the slide member in a working position in the rail to prevent unintentional retraction into or disconnection from the rail, and means for flexing the disconnect latch for releasing the slide member from the working position to the retracted position and for absorbing shock energy produced when the slide member engages the detent means.

10. The slide assembly of claim 9 further including mounting means comprising a recess in the disconnect latch and slide member, and a fastener in the recess securing the disconnect latch to the slide member.

11. The slide assembly of claim 9 wherein the detent means for stopping the slide assembly in the working position comprises a detent formed in an upper surface of the latch and a post on the rail for locking reception of the detent.

12. The slide assembly latch of claim 9 wherein the flexing means comprises at least one generally vertical slot.

13. The slide assembly latch of claim 12 wherein the generally vertical slot is laterally compressible.

14. The slide assembly latch of claim 12 wherein the generally vertical slot is laterally expandable.

15. The slide assembly of claim 9 wherein the flexing means comprises two opposed, generally vertical spaced-apart slots.

16. The slide assembly latch of claim 15 wherein the two generally vertical slots are spaced apart and in opposing directions, one of the slots facing upwardly and one facing downwardly.

17. The locking disconnect latch of claim 15 wherein one of the slots includes a stiffener.

* * * * *